United States Patent [19]

Dunstan et al.

[11] 3,939,959

[45] Feb. 24, 1976

[54] ACCELERATING AND DECELERATING MOVING WALKWAY

[75] Inventors: Phillip Elwyn Dunstan; Sam Shapiro, both of Seattle, Wash.

[73] Assignee: The Boeing Company, Seattle, Wash.

[22] Filed: Mar. 11, 1974

[21] Appl. No.: 450,093

[52] U.S. Cl. ..... 198/16 MS; 198/110

[51] Int. Cl.[2] ..... B66B 9/12

[58] Field of Search ..... 198/16 MS, 16 R, 17, 18, 198/76, 110, 181; 104/25

[56] References Cited

UNITED STATES PATENTS

| | | | |
|---|---|---|---|
| 2,756,686 | 7/1956 | Kendall et al. | 198/16 MS |
| 2,936,873 | 5/1960 | Seidman | 198/16 MS |
| 3,399,758 | 9/1968 | Karr | 198/16 R |
| 3,485,182 | 12/1969 | Crowder et al. | 104/25 |
| 3,498,445 | 3/1970 | Piper | 198/181 |
| 3,601,246 | 8/1971 | Dubois | 198/110 |
| 3,712,448 | 1/1973 | Burson et al. | 198/16 MS |
| 3,744,431 | 7/1973 | Cumberbirch | 198/110 |

FOREIGN PATENTS OR APPLICATIONS

| | | |
|---|---|---|
| 624,607 | 11/1962 | Belgium |

*Primary Examiner*—Richard A. Schacher
*Attorney, Agent, or Firm*—Christensen, O'Connor, Garrison & Havelka

[57] ABSTRACT

A moving walkway having accelerating and decelerating regions whereat people and/or freight board and alight from the walkway, respectively, is disclosed. The walkway comprises a plurality of overlapping platforms with a pair of wheels or rollers affixed beneath one end of each platform. The platforms move in an oval, substantially planar, track having lengthy sides joined by curved ends. Users (people or freight) are moved in opposite directions along the lengthy sides and board and alight from the walkway at entry and exit regions located at both curved ends. Acceleration occurs immediately subsequent to the entry regions and deceleration occurs just prior to the exit regions. The platforms are interconnected by chains or cables movably attached to cam followers. The cam followers follow acceleration and deceleration cams located beneath the platforms. Through the chains or cables this cam action causes the amount of overlapping to increase or decrease to create platform acceleration and deceleration.

17 Claims, 8 Drawing Figures

ACCELERATING AND DECELERATING MOVING WALKWAY

BACKGROUND OF THE INVENTION

This invention is directed to moving walkways and, more particularly, to moving walkways having acceleration and deceleration regions.

A wide variety of moving walkways, some with and some without accelerating and decelerating regions, have been proposed. For a variety of reasons, prior art moving walkway proposals have been somewhat unsatisfactory when attempts have been made to implement them. For example, many prior art moving walkways are formed of platforms which move people and/or freight in one direction from an entry region to an exit region. The platforms return from the exit region to the entry region along a path located directly, vertically beneath the path along which the people or freight are moved, whereby the overall structure is relatively thick. Because it is thick, a substantial depression must be created where such a structure is to be installed, or relatively long and high entrance and exit ramps must be provided. Thus, such prior art walkways cannot be readily installed on an existing horizontal surface. In addition, such prior art moving walkways have the disadvantage that less than half of their path of travel is actually utilized to carry people or freight. Rather, over half of their path of travel is utilized to return platforms from the exit region to the entry region, see U.S. Pat. No. 3,712,488, for example.

Moving walkways which overcome some of these disadvantages have also been proposed. However, they have other types of disadvantages. For example, the passenger conveyor or moving walkway proposed in U.S. Pat. No. 3,583,543, has the disadvantage that it can only accelerate to approximately twice its entry speed, because of the mechanical nature of its platform coupling structure. Assuming that a safe boarding speed is 2.0 mph, this means that such as system can only move passengers at a maximum speed of 4.0 mph.

In addition, many prior art moving walkways are more complicated than desired. Thus, they are subject to frequent mechanical breakdowns. Moreover, many of them are not suitable for use between widely separated exit and entry regions, such as those separated by a quarter of a mile or more.

Therefore, it is an object of this invention to provide a new and improved moving walkway.

It is a further object of this invention to provide a new and improved moving walkway having acceleration and deceleration regions.

It is a still further object of this invention to provide a new and improved accelerating and decelerating moving walkway adapted to carry passengers or freight over a substantial portion of a planar path of travel.

It is yet another object of this invention to provide a new and improved accelerating and decelerating passenger conveyor that is relatively uncomplicated, and therefore suitable for widespread use over extended distances.

SUMMARY OF THE INVENTION

In accordance with principles of this invention, an accelerating and decelerating moving walkway suitable for moving people or freight in either direction between two points is provided. The walkway comprises a plurality of overlapping platforms which move in an oval path of travel. The platforms are connected together by an extendable and retractable means, such as a chain or cable. The extension and retraction of the extendable and retractable means is controlled by a cam/cam follower arrangement such that during acceleration the extendable and retractable means is extended and during deceleration the extendable and retractable means is retracted. The extension and retraction of the extendable and retractable means cause the amount of platform overlap to decrease and increase, respectively, to thereby create acceleration and deceleration.

In accordance with other principles of this invention, the extendable and retractable means comprises a plurality of chain or cable sections, one secton interconnecting each platform with its adjacent platform. The interconnecting portions of the chain or cable section lie along the longitudinal centerline of the platforms in the direction of travel whereby all forces between the platforms are symmetrical, about the overall oval path of travel.

In accordance with further principles of this invention, the oval path of travel includes parallel sides joined by curved ends. The parallel sides are adapted to move people or freight in opposite directions and each includes an accelerating and decelerating region. Preferably the parallel sides are relatively long, in the range between one-quarter mile and several miles.

In accordance with still further principles of this invention, the cam/cam follower arrangement comprises a cam formed of a pair of diverging and converging rails located beneath the platform in the acceleration and deceleration regions or zones, and cam followers formed of members adapted to follow the rails. As the cam followers move inwardly and outwardly, as they follow the rails, the length of the interconnecting chain or cable extends and retracts to cause the desired decrease or increase in platform overlap.

In accordance with still other principles of this invention, a rotating means is located at the platform overlap region. The rotating means is pinned to one of the platforms and interacts with combs formed in the other platform in a manner such that the rotating means rotates with respect to one patform when the platforms pass through the curved portion of the oval path of travel.

In accordance with yet further principles of this invention, each platform includes a pair of wheels mounted on an axle affixed beneath one end of each platform. The other ends of the platforms ride on the upper surface of adjacent platforms above the region where the wheels and axle are located. Thus, each platform supports an adjacent platform in an overlapping manner.

It will be appreciated from the foregoing brief summary that the invention provides a new and improved accelerating and decelerating moving walkway. Because the walkway is relatively planar, no lengthy and extensive approach ramps or other means for raising people and/or freight to the elevation of the moving walkway are needed. Further, a major portion of the orbit of travel is used for moving people and/or freight, rather than only one-half or less.

The invention is relatively uncomplicated in that it merely requires a suitable track, platforms, means to interconnect the platforms and drive means. A suitable drive means may comprise a plurality of motor driven collars mounted beneath the platforms so that the collars sequentially move the platforms. Because of its unique arrangement of components, the invention can accelerate to a higher constant speed than can prior art devices. More specifically, moving walkways which operate at a uniform velocity are limited to a maximum boarding and alighting speed (approximately 2.0 mph) for their entire length of travel. Other walkways which have accelerating and decelerating regions have only been able to provide a twofold (or slightly greater) increase in this speed, i.e., to approximately 4.0 mph. On the other hand, this invention can accelerate passengers or freight smoothly and safely from a safe boarding speed to speeds up to 15 mph, and then decelerate to a safe alighting speed. Thus, the invention makes it practicable to provide moving walkway transportation between points separated by up to several miles.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
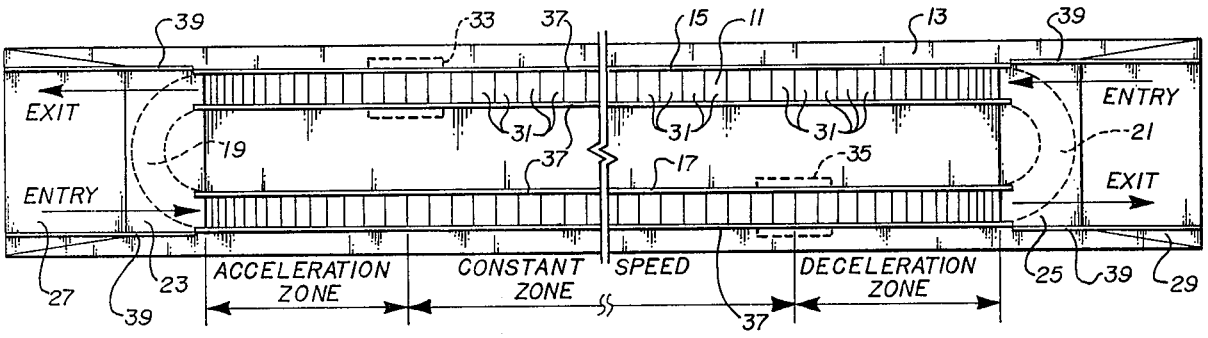
FIG. 1 is a plane view of a preferred embodiment of the invention.
Figure 2:
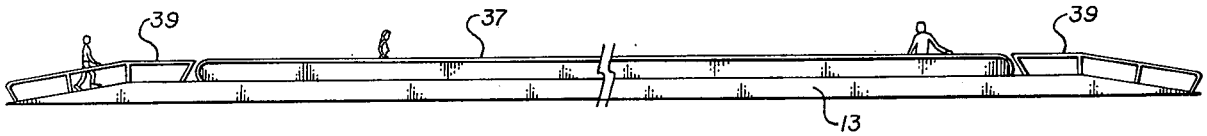
FIG. 2 is a side view of the preferred embodiment of the invention illustrated in FIG. 1.

FIGS. 1 and 2 illustrate a preferred embodiment of a moving walkway formed in accordance with the invention and comprises a plurality of platforms 31 which move in an oval, substantially planar, track 11 formed in the housing 13. The oval planar, substantially planar, track includes two parallel sides 15 and 17 connected by curved end regions 19 and 21. The curved end regions 19 and 21 are covered by covers 23 and 25 forming part of the housing 13. Short ramps 27 and 29 lead up to and down from the covers 23 and 25. Each parallel side 15 and 17 is broken into three zones — an acceleration zone; a constant speed zone; and, a deceleration zone. The zones run from left to right for the lower side 17 as viewed in FIG. 1 and vice versa (i.e., right to left) for the upper side 15, also as viewed in FIG. 1.

As will be better understood from the following description, the plurality of platforms 31 continuously move through the oval track 11. Thus, the platforms are continuously passing through the two accelerating zones, the two constant speed zones and the two decelerating zones; and, through the curved end regions 19 and 21.

Each end of the moving walkway illustrated in FIGS. 1 and 2 includes an entry region and an exit region. Entry is into the accelerating zones and exit is from the decelerating zones. Thus, people desiring to use the walkway illustrated in FIG. 1 or freight to be transported by the walkway, enter the side 17 of the oval track, illustrated in the lower position of the figure, from the left and exit from the right side and vice versa for the other side 15, as illustrated by the entry and exit arrows. Drive units, preferably of the type hereinafter described, are located at the beginning of each decelerating zone in regions 33 and 35. The drive units cause the platforms 31 to constantly move about the oval, substantially planar, track in the desired manner.

Preferably, as illustrated in FIG. 2, accelerating and decelerating handrails 37 are located on either side of both of the parallel sides 15 and 17 of the oval track 11. Since the accelerating and decelerating handrails form no part of this invention, they are not further described herein. They may, however, be formed of suitable types of platform-like sections which accelerate and decelerate in zones corresponding to the platform acceleration and deceleration zones. In addition, side handrails 39, located on either side of the ramps 27 and 29 and the covers 23 and 25, may be included, if desired.

Figure 4:
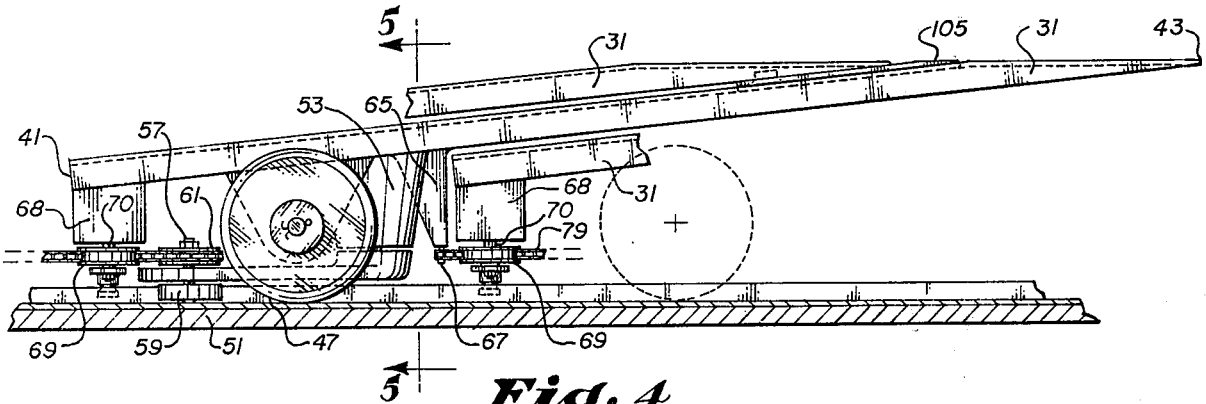
FIG. 4 is a cross-sectional view of platforms, and their associated apparatus, formed in accordance with the invention.
Figures 3, 6:
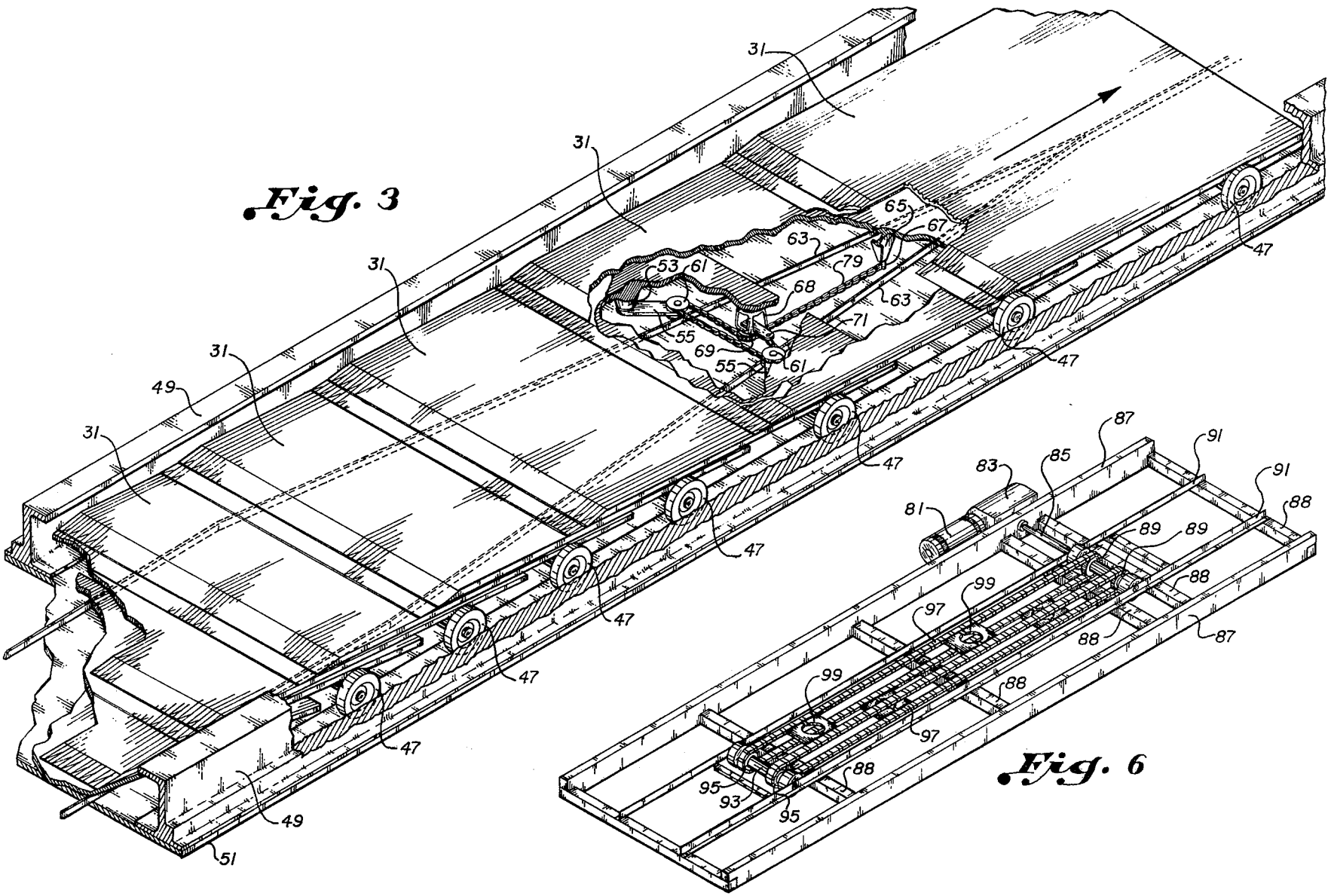
FIG. 3 is a perspective view, partially broken away, illustrating a portion of the preferred embodiment of the invention in an accelerating zone.
FIG. 6 is a perspective view of a mechanism suitable for moving the platforms formed in accordance with the invention.

FIG. 3 is a perspective view, partially broken away, illustrating a plurality of platforms 31 in an acceleration zone. As also seen in FIG. 4, each platform is generally planar and includes a relatively thick front edge 41 and a rear edge which feathers into a tip 43. (As used herein, the terms "front edge" and "rear edge" relate to the illustrated direction of movement. Since the direction of movement can be reversed, these terms are reversible, i.e., what is recited as "front" will become "rear" and what is recited as "rear" will become "front" if the direction of travel is reversed.) More specifically, the platforms include relatively planar, parallel tops and bottoms, except near the rear end. Toward the rear end, the tops incline toward the bottoms so as to form the rear edge tip 43. In other words, the platforms are trapezoidal when viewed in cross section. In addition, as will be better understood from the following description, the upper surface of the platforms is "combined".

Mounted slightly rearwardly of the front edge of each platform are downwardly projecting flanges 45, one located on either side of the platform. The flanges 45 support an axle 46 having a longitudinal axis that is orthogonal to the axis of the path of platform movement. Mounted on the axle 46 so as to lie beyond the outer surfaces of the flanges 45 are a pair of wheels 47. Thus, the wheels 47 support the front edges 41 of the platforms 31.

The wheels 47 are arrayed in tracks 49, one located on either side of the orbit of travel of the platforms 31. The tracks 49 are channels, U-shaped in cross section, and rotated 90° so that their openings face one another. The channels 49 are affixed to a suitable base plate 51 and define an oval, substantially planar, path of travel about which the platforms 31 move. Both the channels 49 and the base plate 51 form a portion of the housing 13 (FIG. 1). While the base plate 51 is illustrated as solid, it may be formed of suitably located brace members, if desired.

Affixed to and extending downwardly from each platform 31, "behind" its associated axle 46, are a pair of support brackets 53. The support brackets 53 are also located on either side of the longitudinal centerline of the platforms 31, as defined by the oval planar path of travel 11. Rotatably attached to the lower end of each support bracket 53 and extending inwardly therefrom are a pair of arms 55. A vertical shaft 57 extends through the outer end of each arm 55. Rotatably mounted on each vertical shaft 57, beneath its associated arm 55, is a roller 59 that acts as a cam follower. Also rotatably mounted on each vertical shaft 57, above its associated arm 55, is a sheave 61.

Affixed to the base plate 51 on opposite sides of the longitudinal axis defined by the oval planar path of travel 11 are a pair of cams 63. While the cams 63 can take on a variety of shapes, preferably, as illustrated, they are straight, right angle (in cross-section), longitudinal members which are affixed along one side to the base plate 51. The rollers 59 forming the cam followers ride on the thusly created vertical surfaces of the cams 63.

As illustrated in FIG. 3, the cams 63 diverge inwardly in the accelerated zones. Contrawise, in the deceleration zones, the cams diverge outwardly. While the cams can encompass the entire oval path of travel, as generally illustrated in FIG. 3, preferably, they only exist in the acceleration and deceleration zones. When the platforms 31 are in the constant speed zone, a suitable stop mechanism (not shown) locks the arms 55 in their most inward positions, which position, as will be better understood from the following description, allows the least amount of platform overlap to exist. The force created by the stop mechanism is overcome by any suitable mechanism (also not shown) when the platforms leave the constant speed zone and enter a deceleration zone. When in the curved end zones, the platforms are free to "float" with respect to one another.

Mounted slightly behind the support brackets 53, and projecting downwardly from each platform 31, is a pin bracket 65 which terminates in a tip 67.

Centrally located at the front edges of each platform, and projecting downwardly therefrom is a further support bracket 68. The further support bracket 68 is generally aligned along the longitudinal axis defined by the oval path of travel 11. The further support bracket 68 supports vertical shaft 70 on which a sheave 69 is rotatably mounted. Vertical shaft 70 is on one side of the longitudinal axis defined by the oval path of travel. A vertical pin 71 projects downwardly from an arm 72 affixed to the further support bracket 68 and lies on the other side of the same longitudinal axis. A suitable extendable and retractable member 79, such as a chain (illustrated) or a cable, extends from pin 67 to pin 71 about the three sheaves—the two mounted on the arms 55 and the one mounted on the further support bracket 68. More specifically, starting with the pin 67 mounted on the platform immediately in front of the platform of interest, the extendable and retractable member 79 extends along the longitudinal axis defined by the oval path of travel and then passes about the sheave 69 attached to the further support bracket 67. The extendable and retractable member 79 then pass outwardly around the sheave 61 mounted on the arm 55 illustrated on the left in FIG. 5. The member 79 then crosses through the longitudinal axis and passes about the sheave 61 mounted on the arm 55 illustrated on the right in FIG. 5. The member then extends to the pin 71, where it terminates. This path of the extendable and retractable member 79 is clearly shown in FIG. 3.

It should be noted that if the extendable and retractable member is a chain as illustrated, the various sheaves are, preferably, toothed sheaves. Contrawise, if the extendable and retractable member is a cable, such as a steel cable, the sheaves are not toothed.

From the foregoing description of the path followed by the extendable and retractable member 79, and viewing FIG. 3, it will be readily understood that, as the rollers 59 follow the cams 63 and the arms 55 are moved inwardly and outwardly, the member 79 extends and retracts. This extension and retraction causes the amount of platform overlap to decrease and increase, respectively. In this manner, platform acceleration and deceleration in the acceleration and deceleration zones, whereat the diverging cams are located, occurs.

A variety of devices can be utilized to move the platforms making up the moving walkway of the invention. One such device is illustrated in FIG. 6 and comprises an electric motor 81 adapted, through a gear box 83, to drive a drive shaft 85. The drive shaft 85 is orthogonally, rotatably mounted with respect to a pair of parallel side rails 87. Affixed to the shaft 85 are a pair of spaced drive gears 89. The spaced gears 89 are located between a pair of center support rails 91 lying parallel to the parallel side rails 87 and supported by cross rails 88. An idler shaft 93 lying parallel to the drive shaft 85 is also mounted between the pair of center support rails 91. Mounted on the idler shaft 93 are a pair of spaced idler gears 95. Chains or belts 97 mounted in parallel, side-by-side relationship so as to move in spaced, parallel vertical planes, pass about the drive gears 89 and the idler gears 93 on a one-to-one basis. Affixed between the chains or belts 97 are collars 99.

A drive mechanism of the type described above, or a similar drive unit, form the drive units located in regions 33 and 35, illustrated in FIG. 1. As the motor 81 rotates the drive shaft 85, the belts and collars 99 move in the desired direction.

The collars 99 coact with drive lugs 101 that project downwardly from support plates 102. The support plates are affixed to the lower ends of a vertical shaft 70 and pin 71. The coaction is such that each succeeding collar grips the lug of the next platform and moves the platform until the collar releases from the drive lug it has gripped. In this manner the platforms are constantly being moved through the deceleration zones. Undriven platforms located in the other zones are, of course, pushed "forward" by the driven platforms.

Figure 5:
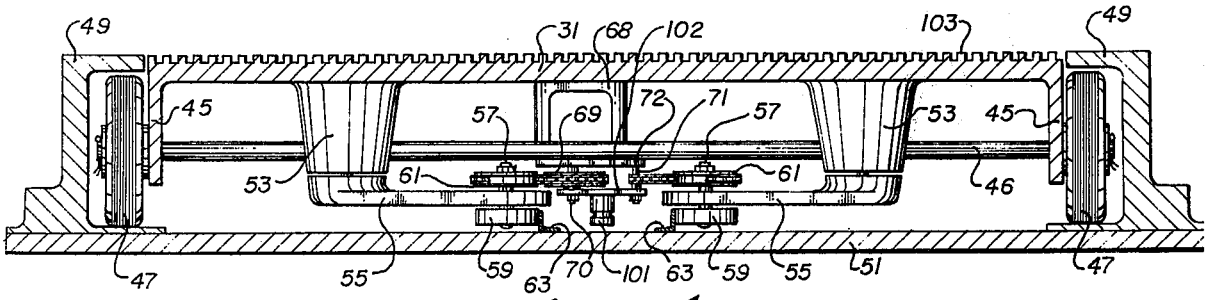
FIG. 5 is a cross-sectional view along line 5—5 of FIG. 4.
Figures 7, 8:
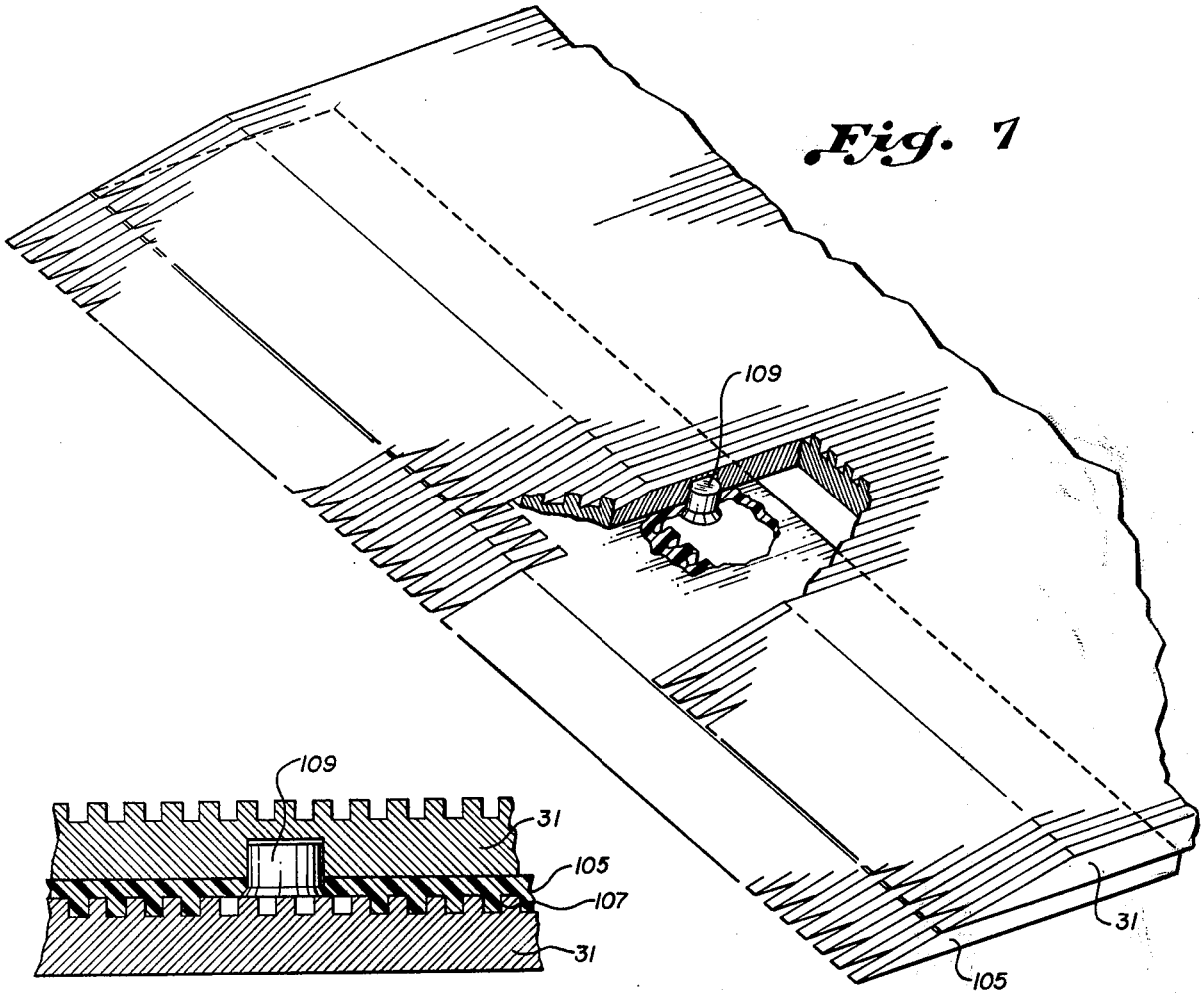
FIG. 7 is a perspective view, partially broken away, of an interconnecting plate which allows platforms, formed in accordance with the invention, to move about the curved end of an oval track; and, FIG. 8 is a fragmentary cross-sectional view illustrating the interconnection between the interconnecting plate and the platforms illustrated in FIG. 7, in somewhat more detail.

Preferably, as illustrated in FIG. 5, the upper surfaces of the platforms are comb like, i.e., they include a plurality of parallel raised members or "teeth" 103 arrayed in side-by-side relationship, parallel to the axis of the oval path of travel. One of the problems with the use of the comb-like platform surface, particularly if some of the teeth thereof intermesh to maintain lateral alignment, is that such surfaces will prevent the platforms from turning in the curved end regions 19 and 21 illustrated in FIG. 1. In order to overcome this problem without loss of the desired alignment, a correspondingly combed rotatable plate 105 (FIGS. 7 and 8) is located between the bottom rear end of one platform and the top front end of the adjacent platform. The combed rotatable plate 105, as best seen in FIG. 8, includes a combed lower surface. The combed lower surface meshes with the combs formed in the upper surface of the adjacent platform 31. The upper surface of the combed rotatable plate is flat (not combed) and is pinned to the bottom rear of its associated platform 31 by a pin 109. The pinned upper surface and the combed lower surface of the combed rotatable plate 105 prevent lateral movement between the associated platforms. However, swivel movement about the longitudinal axis of the pin 109 is not prevented. Thus, the platforms are free to swivel with respect to one another as they move through the curved end regions 19 and 21. Preferably, the joining surfaces of the plate 105 and the upper platform 31 are as friction free as possible. For example, they may be coated with teflon.

It will be appreciated from the foregoing description that the invention provides a new and improved accelerating and decelerating moving walkway. The apparatus is umcomplicated, yet, the walkway is movable in a substantially planar oval track. Thus, the overall structure has a relatively low silhouette which allows it to be easily installed on the present walkways, for example. Moreover, the unique apparatus of the invention allows people to be moved at speeds unobtainable with prior art apparatus. Thus, the invention is suitable for use over relatively long distances, such as one-quarter of a mile or greater. In fact, the invention can be extended up to several miles in length, if desired. Hence, the invention is suitable for widespread use. Although not illustrated in the drawings, if desired, certain regions of the platforms, such as the rear upper surfaces thereof, can be painted to provide "step-on" regions, if desired.

While a preferred embodiment of the invention has been illustrated and described, it will be appreciated by those skilled in the art and others that various changes can be made therein without departing from the spirit of the invention. Hence, the invention can be practiced otherwise than as specifically described herein.

The embodiments of the invention in which an exclusive property or privilege is claimed are defined as follows:

1. An accelerating and decelerating moving walkway comprising:

1. path of travel defining means for defining an oval, substantially planar, path of travel;
2. a plurality of overlapping platforms mounted in said path of travel defining means for movement about said oval, substantially planar, path of travel;
3. overlapping control means for controlling the amount of overlap between adjacent platforms of said plurality of overlapping platforms, said overlapping control means comprising:
   a. cam means mounted beneath said plurality of overlapping platforms for controlling the position of cam follower means associated with each of said plurality of platforms;
   b. cam follower means associated with and mounted on each of said plurality of platforms so as to contact with and be positioned adjustable by said cam means in a plane lying parallel to the plane defined by said oval, substantially planar, path of travel; and
   c. flexible extendable and retractable means running between pairs of adjacent platforms of said plurality of platforms and operatively connected to said cam follower means such that the position of said cam follower means controls the length of said flexible extendable and retractable means running between pairs of adjacent platforms to thereby control the amount of platform overlap; and,
4. drive means adapted to be selectively coupled to said plurality of platforms for moving said plurality of platforms about said oval, substantially planar, path of travel.

2. An accelerating and decelerating moving walkway as claimed in claim 1 wherein said oval, substantially planar, path of travel defines a longitudinal axis and includes two sides lying generally parallel to one another, said sides being connected by curved ends.

3. An accelerating and decelerating moving walkway as claimed in claim 2 wherein each of said two sides includes an acceleration region wherein the amount of platform overlap increases and a deceleration region wherein the amount of platform overlap decreases.

4. An accelerating and decelerating moving walkway as claimed in claim 3, wherein:

said cam means comprises at least one longitudinal member mounted beneath said plurality of platforms in each of said acceleration and deceleration regions, said at least one longitudinal member converging toward said longitudinal axis defined by said oval, substantially planar, path of travel in said acceleration regions and diverging from said longitudinal axis defined by said oval, substantially planar, path of travel in said deceleration regions;

said cam follower means comprises at least one arm rotatably attached at one end to each of said plurality of platforms and a roller associated with each of said at least one arms and rotatably mounted on the other end thereof, said arms and rollers being attached such that the rollers are adapted to ride on said at least one longitudinal members when their associated platforms are located above said at least one longitudinal members, said rollers riding on said at least one longitudinal members acting to rotate their associated arms with respect to their associated platforms; and, said extendable and retractable means comprises an extendable and retractable member running between each pair of adjacent platforms of said plurality of platforms, one end of said extendable and retractable member being affixed to one of said pair of adjacent platforms and the other end being affixed to the other of said pair of adjacent platforms, said extendable and retractable member being operatively connected to said at least one arm associateed with one of said pair of adjacent platforms in a manner such that when said arm is rotated by its associated roller impinging on one of said at least one longitudinal members the length of said extendable and retractable member running between said pair of adjacent platforms is varied whereby the amount of overlap between said pair of adjacent platforms is varied.

5. An accelerating and decelerating moving walkway as claimed in claim 4 including:

an axle associated with each of said plurality of platforms;

mounting means associated with each of said plurality of platforms for mounting said axles such that the longitudinal axis defined by said axles lies beneath said platforms and generally orthogonal to the longitudinal axis defined by said oval, substantially planar, path of travel; and, a pair of wheels associated with each of said plurality of platforms, said wheels being mounted on the ends of said axles.

6. An accelerating and decelerating moving walkway as claimed in claim 5 including a sheave mounted on each of said at least one arms on the same end thereof on which said roller is mounted, said extendable and retractable member passing about said sheave.

7. An accelerating and decelerating moving walkway as claimed in claim 6 including a second sheave rotatably affixed to each of said plurality of platforms and associated with said at least one arm mounted thereon such that said extendable and retractable member passes about said second sheave prior to running toward the other of said pair of adjacent platforms.

8. An accelerating and decelerating moving walkway as claimed in claim 7 including a plate located between each of said pair of adjacent platforms in the region where they overlap.

9. An accelerating and decelerating moving walkway as claimed in claim 8 wherein the upper surfaces of said plurality of platforms are comblike and wherein the lower surface of the plates between said pairs of adjacent platforms is also comblike and intermeshes with the comblike upper surface of the platforms they face.

10. An accelerating and decelerating moving walkway as claimed in claim 9, wherein the upper surface of said plates is relatively smooth and is connected to the adjacent surface of the platform lying above it by a pin.

11. An accelerating and decelerating moving walkway as claimed in claim 10, wherein the trailing edge of each of said plurality of platforms tapers to a feather edge.

12. An accelerating and decelerating moving walkway as claimed in claim 1, wherein:

said oval, substantially planar, path of travel includes two acceleration regions and two deceleration regions;

said cam means comprises two longitudinal members located beneath said plurality of platforms in each of said accelerating and decelerating regions, said longitudinal members converging inwardly with respect to the direction of travel in said acceleration regions and diverging outwardly with respect to said direction of travel in said deceleration regions;

said cam follower means comprises: a plurality of pairs of arms, one of said pairs being affixed at one end to each of said platforms; a plurality of rollers one roller being mounted on the other end of each of said arms so as to ride on said longitudinal members; and, a plurality of sheaves, one sheave also mounted on said other end of each of said arms; and, said extendable and retractable means comprises a plurality of extendable and retractable members, one of said extendable and retractable members running between each pair of adjacent platforms of said plurality of platforms about the sheaves mounted on the pair of arms associated with one of said pair of platforms such that when said sheaves are moved with respect to one another by said arms moving by said rollers impinging on said longitudinal members, the length of said extendable and retractable members running between said pairs of adjacent platforms is varied.

13. An accelerating and decelerating moving walkway as claimed in claim 12 including:

an axle associated with each of said plurality of platforms;

mounting means associated with each of said plurality of platforms for mounting said axles such that the longitudinal axis defined by said axle lies beneath said platforms and generally orthogonal to the longitudinal axis defined by said oval, substantially planar, path of travel; and, a pair of wheels associated with each of said plurality of platforms, said wheels being mounted on the ends of said axles.

14. An accelerating and decelerating moving walkway as claimed in claim 13 including a plate located between each of said pair of adjacent platforms in the region where they overlap.

15. An accelerating and decelerating moving walkway as claimed in claim 14, wherein the upper surfaces of said plurality of platforms are comblike and wherein the lower surface of the plates between said pairs of adjacent platforms is also comblike and intermeshes with the comblike upper surfaces of the platforms they face.

16. An accelerating and decelerating moving walkway as claimed in claim 15, wherein the upper surface of said plates is relatively smooth and is connected to the adjacent surface of the platform lying above it by a pin.

17. An accelerating and decelerating moving walkway as claimed in claim 16, wherein the trailing edge of each of said plurality of platforms tapers to a feather edge.

* * * * *

UNITED STATES PATENT AND TRADEMARK OFFICE

CERTIFICATE OF CORRECTION

PATENT NO. : 3,939,959

DATED : February 24, 1976

INVENTOR(S) : Dunstan et al

It is certified that error appears in the above-identified patent and that said Letters Patent are hereby corrected as shown below:

Claim 3, Column 8, line 16, delete "increases" and insert therefor —decreases—;

Column 8, line 17, delete "decreases" and insert therefor —increases—.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*